United States Patent [19]

Miller et al.

[11] Patent Number: 5,035,176

[45] Date of Patent: Jul. 30, 1991

[54] FLUID DAMPER SYSTEM FOR PRINTING APPARATUS

[75] Inventors: Dale W. Miller, Glen Ellyn, Ill.; Thomas A. Crofutt, Shelton, Conn.

[73] Assignee: Rockwell International Corporation, Pittsburgh, Pa.

[21] Appl. No.: 425,007

[22] Filed: Oct. 20, 1989

[51] Int. Cl.[5] ..... B41L 25/06

[52] U.S. Cl. ..... 101/148; 101/147

[58] Field of Search ..... 101/148, 147; 239/DIG. 12, 588

[56] References Cited

U.S. PATENT DOCUMENTS

| | | | |
|---|---|---|---|
| 1,752,193 | 3/1930 | O'Hanlon | 239/588 |
| 1,991,962 | 2/1935 | Schultz | 101/148 |
| 2,759,765 | 8/1956 | Pawley | 239/588 |
| 3,228,613 | 1/1966 | Goldstein | 239/585 |
| 3,694,238 | 9/1972 | Tinghitella et al. | 101/148 |
| 4,044,674 | 8/1977 | Smith | 101/148 |
| 4,077,317 | 3/1978 | Kiesewetter et al. | 101/37 |
| 4,143,596 | 3/1979 | Ivett | 101/148 |
| 4,407,196 | 10/1983 | Matalia et al. | 101/148 |
| 4,831,927 | 5/1989 | Lin | 101/148 |

*Primary Examiner*—Edgar S. Burr
*Assistant Examiner*—John S. Hilten
*Attorney, Agent, or Firm*—Nies, Kurz, Bergert & Tamburro

[57] ABSTRACT

Printing apparatus including a novel fluid dampener system for delivering an even, uniform film of dampener fluid onto a printing cylinder and the printing plate mounted thereon to eliminate the problem of edge scumming on the printed web.

3 Claims, 2 Drawing Sheets

FLUID DAMPER SYSTEM FOR PRINTING APPARATUS

BACKGROUND OF THE INVENTION

This invention relates generally to lithographic printing apparatus and, more particularly, to a novel fluid dampener system for delivering an even, uniform film of dampener fluid onto a printing cylinder and the printing plate mounted thereon to eliminate the problem of edge scumming on the printed web.

Conventional lithographic printing apparatus normally includes a rotating plate cylinder on which the printing plate is mounted, an ink delivering system for feeding ink to selected areas on the printing plate, and a fluid dampener system for delivering fluid such as water to other selected areas of the printing plate on which no ink is to be deposited. A common form of fluid dampener system is known as a brush dampener unit and consists of a slowly rotating pan roller which is partially immersed in a pan of dampener fluid. As this roller slowly rotates, it carries on its outer circumferential surface a film of dampener fluid upwards from the pan. A rapidly rotating brush roller consisting of helically mounted bristles is rotated in contact with the pan roller, the bristles of the rotating brush roller wiping the dampener film off the pan roller and flinging it in the form of droplets or a mist onto another rotating drum. The dampener film is transferred from the drum to an engaging rubber-covered form roller and thence to the printing plate mounted on the plate cylinder.

This type of fluid dampener system is known to be confronted with the problem of edge scumming, that is, the unwanted presence of ink on the edges of the printed web which occurs because of the uneven delivery of dampener film across the width of the form roller to the printing plate.

When printing on a full-width web at or close to the design limits of the printing machine, the amount of dampener fluid delivered at the ends of the print cylinder is insufficient to prevent the buildup of ink at the edges. There may be several reasons for this occurrence, but one reason is felt to be the higher temperatures at the ends of the machine elements, including the pan roller, the brush roller, the drum, the form roller, and the print cylinder, which higher temperatures cause greater evaporation of the dampener fluid in the end areas of the rollers.

Prior attempts to overcome this problem have been unsuccessful. For example, increasing the speed of the pan roller to a point where the dampener fluid feed rate allows the edges on the web to clean up has produced other problems such as overfeed of fluid in the central area of the print cylinder which results in a deterioration in print quality in that area. Another proposal to add additional bristles at the ends of the brush rollers to try to feed more dampener fluid in those areas has been ineffective, because the speed differential between the brush roller and the pan roller is so great that the normal brush is already taking away all the dampener fluid delivered to it.

SUMMARY OF THE INVENTION

Accordingly, a primary object of the invention resides in the provision of lithographic printing apparatus including a novel fluid dampener system for delivering a sufficient amount of dampener fluid to the plate cylinder and printing plate mounted thereon so as to avoid and alleviate the problem of edge scumming.

Another object of the invention resides in the provision of the above novel dampener fluid system comprising separate dampener fluid delivery means in addition to the normal dampener fountain pan for providing more dampener fluid at the ends of the rollers than in the middle, thereby eliminating any tendency of the ink to scum at the edges of the printing plate while at the same time enabling the middle areas of the plate to print at optimum performance.

Still another object of the invention resides in the provision of the above novel dampener fluid system comprising nozzle assemblies positioned adjacent the ends of a dampener fluid delivery roller, such as the fountain roller, the nozzle assemblies being adjustable so that the additional dampener fluid may be directed at a variety of locations along the ends of the roller.

A further object of the invention resides in the provision of the above novel fluid dampener system wherein the nozzle assemblies are relatively simple in construction but yet effective in eliminating the edge scumming problem.

These and other objects and advatages of the invention will become apparent as the description proceeds in connection with the accompanying drawings.

DETAILED DESCRIPTION OF THE INVENTION

Figures 1, 2:
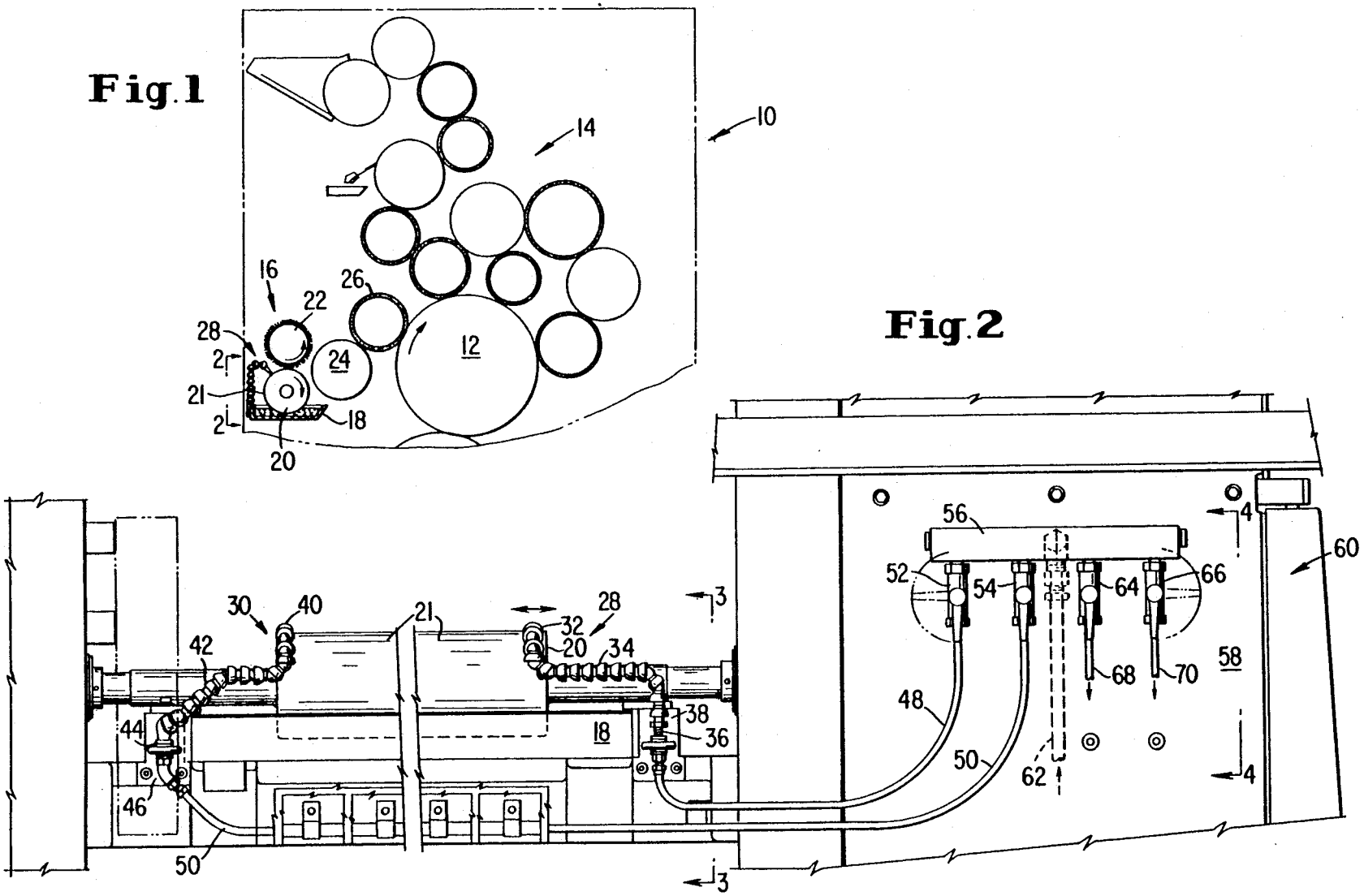
FIG. 1 is a diagrammatic side view of the plate cylinder of a lithographic printing machine illustrating a conventional ink roller system and the novel fluid dampening roller system of the invention.
FIG. 2 is a fragmentary view, taken generally along Line 2—2 of FIG. 1, illustrating the dampener fountain roller assembly of the invention including the novel adjustable fluid nozzles at the ends of the fountain roller.

Referring to FIG. 1, a lithographic printing machine 10 comprises an upper printing unit including a plate cylinder 12, an ink roller distribution system 14 for delivering ink to cylinder 12, and a spiral brush dampener system 16 for applying a dampening liquid such as water to cylinder 12.

Figure 3:
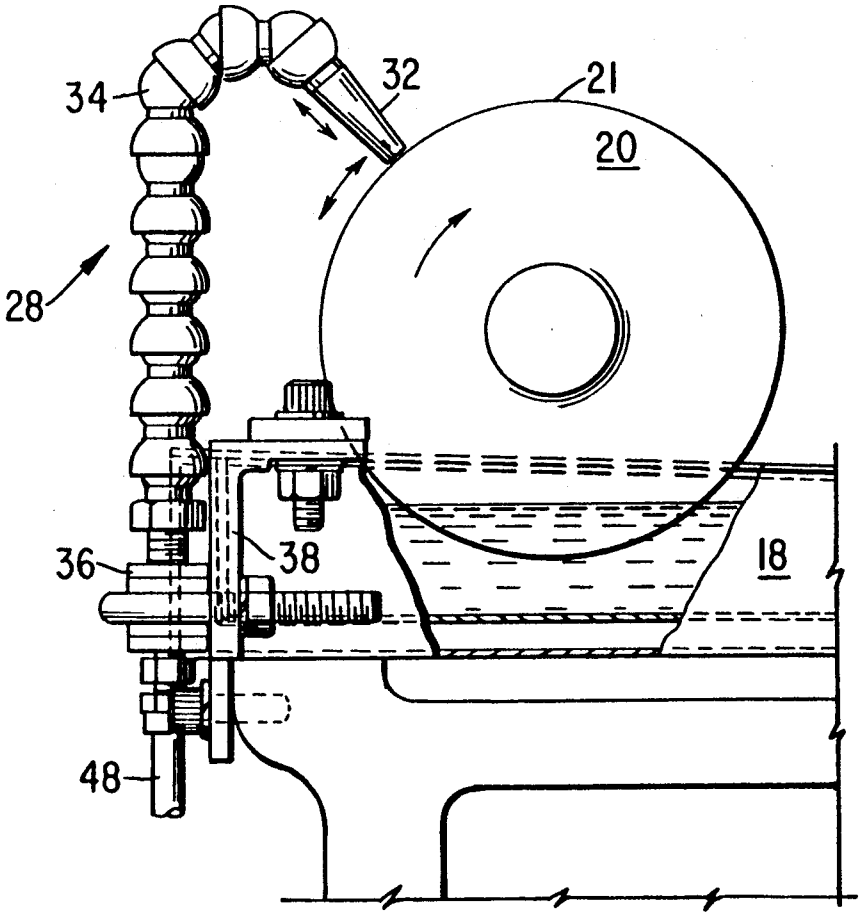
FIG. 3 is a fragmentary side view, taken along Line 3—3 of FIG. 2, illustrating a fluid nozzle adjacent the circumference of the fountain roller.

As shown in FIGS. 1, 2 and 3, dampener system 16 includes a fountain pan 18 containing a bath of the dampening liquid, a slowly rotating metal fountain roller 20 of stainless steel or chrome-plated construction and partially immersed in the liquid in pan 18, the roller 20 having a circumferential surface 21 of an axial width sufficient to provide a full web width, e.g., of about sixty-six inches. A rapidly rotating brush roller 22 comprises continuous or non-continuous helically mounted bristles which engage against surface 21. As roller 20 slowly rotates clockwise as shown in FIGS. 1 and 3, it carries a film of liquid across surface 21 upwards from pan 18. Rapidly rotating brush roller 22 wipes the film off surface 21 and flings the liquid in the form of droplets or a mist onto a stainless steel or chrome-plated drum 24. The mist or film on drum 24 is then transferred onto an engaging rubber-covered form roller 26 and in turn onto plate cylinder 12. The level of the bath liquid in pan 18 may be maintained in the usual fashion by a pump, drain, and supply system.

The operation of the dampener system as just described is conventional and, as noted initially hereinabove, is confronted with the problem of edge scumming, i.e., the presence of ink on the edges of the printed web where none is desired. As already mentioned, this occurs because of an uneven delivery of dampener film across the width of form roller 26 to plate cylinder 12, particularly on the ends of cylinder 12 at which the dampener film deposited is not sufficient to prevent the buildup of ink along the edges.

To eliminate the edge scumming problem, the invention includes a pair of adjustable nozzle assemblies 28 and 30 positioned adjacent the ends of fountain roller 20 and adapted to deliver additional dampener liquid on surface 21 at the ends of the roller, and thus provide correspondingly more dampener film to the ends of cylinder 12.

Figure 4:
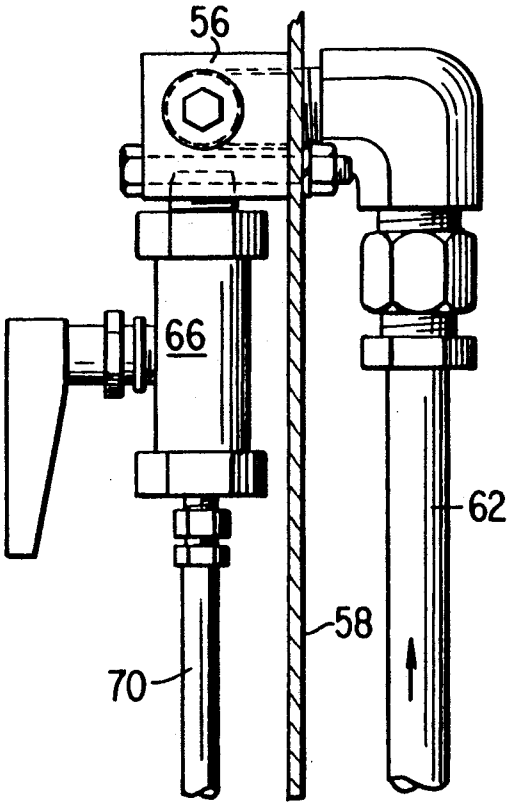
FIG. 4 is a fragmentary elevation view, taken along Line 4—4 of FIG. 2, illustrating the control valve assembly feeding fluid to each of the nozzles.

Nozzle assembly 28 includes a nozzle 32 mounted on the end of a universally adjustable flexible hose 34 extending from a fitting 36 which is clamped to a bracket 38 bolted to the frame of the machine. Similarly, nozzle assembly 30 includes a nozzle 40 mounted on the end of universally adjustable hose 42 extending from fitting 44 clamped to bracket 46 bolted to the frame. It is to be understood that each nozzle assembly may include more than one nozzle, e.g., assembly 28 may include two nozzles 32 connected by way of a "Y" connector to hose 34. As shown in FIGS. 2 and 4, a pair of flexible hoses 48 and 50 connect fittings 36 and 44 with flow control valves 52 and 54, respectively, which connect to header 56 mounted on the outside face of wall 58 of the dampener fluid enclosure 60. Conduit 62 delivers dampener fluid to header 56 from the pump and fluid tank located inside enclosure 60.

Additional valves 64 and 66 and lines 68 and 70 may extend from header 56 to identical nozzle assemblies associated with a lower dampening unit which is normally part of the printing machine.

In operation of the invention, as roller 20 rotates clockwise as shown in FIG. 1, it carries a film of dampener liquid across the full width of surface 21 upwards from pan 18 in usual fashion. Additional fluid is then sprayed on the ends of surface 21 by nozzle assemblies 28 and 30, the amount of additional fluid being controlled by valves 52 and 54. Because of the universal adjustability of hoses 34 and 42, nozzles 32 and 40 may be positioned at a variety of different locations along the ends of surface 21. For example, as shown in FIG. 2, each nozzle may be adjusted about 8 to 10 inches laterally inwardly from the outer edges of surface 21. As shown in FIG. 3, the nozzles may also be adjusted circumferentially around surface 21 and up or down with respect to the surface.

Consequently, additional fluid may be deposited at selected points along the ends of roller 20 to provide more dampener fluid on the ends than in the middle of the roller. Part of that additional fluid may run off roller 20 back into pan 18 and serve as a fill source for the pan. The remainder of the fluid is then transferred via brush roller 22 and drum 24 to form roller 26 and ultimately provides for an even feed of dampener fluid across the full width of roller 26 to cylinder 12. The amount of the additional fluid which is transferred via brush roller 22 is controlled by circumferentially positioning nozzles 32 and 40 around surface 21, i.e., the higher or closer the spray from the nozzles is to brush roller 22, the greater the amount of fluid transferred to drum 24. Thus, a sufficient amount of dampener fluid is present on the ends of cylinder 12 and the printing plate mounted thereon to avoid the buildup of ink and eliminate the edge scumming problem on the web.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A printing apparatus comprising a plate cylinder, fluid dampener means for delivering dampener fluid to said plate cylinder and including fluid supply means, roller means for delivering fluid from said supply means to said plate cylinder, nozzle means positioned adjacent only the ends of said roller means for depositing additional dampener fluid on said ends, means for mounting said nozzle means adjacent said roller means, said mounting means including flexible conduit means supporting said nozzle means and permitting adjustment thereof laterally and circumferentially with respect to said roller means so that said additional dampener fluid may be deposited at various points along the ends of said roller means, and control means for controlling the amount of additional dampener fluid delivered to said nozzle means.

2. The printing apparatus according to claim 1, said fluid supply means including a pan for containing a bath of dampener fluid, said roller means including a fountain roller mounted adjacent said pan and having an outer circumferential surface which passes through said bath of dampener fluid as said fountain roller rotates so that a film of said fluid is carried on said surface away from said bath, said nozzle means being adjustably positioned adjacent said fountain roller to deposit additional fluid on the ends of said surface after it passes through said bath.

3. A printing apparatus comprising a plate cylinder, fluid dampener means for delivering dampener fluid to said plate cylinder including fountain pan means containing a bath of dampener fluid, a rotating fountain roller mounted adjacent said pan means and having an outer circumferential surface which passes through said bath as said fountain roller rotates so that a film of said fluid is carried on said surface upwardly away from said bath, a rotating drum mounted adjacent said fountain roller, a brush roller rotating in contact with said fountain roller and transferring said fluid from said fountain roller to said drum, nozzle means located adjacent only the ends of said fountain roller for depositing additional dampener fluid on said surface at said ends of said fountain roller before said brush roller contacts said surface, means for mounting said nozzle means adjacent said roller means, said mounting means including flexible conduit means supporting said nozzle means and permitting adjustment thereof laterally and circumferentially with respect to said fountain roller so that said addtional dampener fluid may be deposited at various points along the ends of said fountain roller, and control means for controlling the amount of dampener fluid delivered to said nozzle means.

* * * * *